US005606747A

United States Patent [19]

Dupont

[11] Patent Number: 5,606,747

[45] Date of Patent: Mar. 4, 1997

[54] TOILET BOWL ASPIRATING SYSTEM

[76] Inventor: André Dupont, 960 Marie-Victorin, Boucherville, Quebec, Canada, J4B 1Y8

[21] Appl. No.: 490,421

[22] Filed: Jun. 14, 1995

[51] Int. Cl.[6] ..... E03D 9/04

[52] U.S. Cl. ..... 4/213

[58] Field of Search ..... 4/213

[56] References Cited

U.S. PATENT DOCUMENTS

| | | | |
|---|---|---|---|
| 2,100,962 | 11/1937 | Juntunen | 4/213 |
| 3,230,551 | 1/1966 | Kopp | 4/213 |
| 4,031,574 | 6/1977 | Werner | 4/213 |
| 5,235,544 | 7/1994 | Busch | 4/213 |

*Primary Examiner*—Charles E. Phillips

[57] ABSTRACT

A toilet bowl aspirating system for use in a toilet tank having an overflow tube in which a filler tube is disposed to supply water to a channel having a plurality of ports provided in a rim of a toilet bowl and through which water flows about an inner side wall of the bowl during an evacuation cycle. The aspirating system comprises a blower support member which has a tubular adapter for seating engagement over a top end of the overflow tube and extends below a top water level of a toilet tank to provide a closed chamber above the top end of the overflow tube. The blower support member has an exhaust end which is positioned above the top water level and a blower is supported in that end for drawing air from the top end of the overflow tube and the plurality of ports within the toilet bowl during a timer cycle. A filter is associated with the exhaust end to filter odors emitted therefrom and originating in the toilet bowl.

11 Claims, 3 Drawing Sheets

TOILET BOWL ASPIRATING SYSTEM

TECHNICAL FIELD

The present invention relates to a toilet bowl aspirating system for aspirating air within the toilet bowl and to filter the odors emitted therefrom, the blower being actuated by the position of a toilet seat when in use.

BACKGROUND ART

Various devices have been constructed in an attempt to remove odors from toilets and such devices have been provided in kit form to adapt to existing toilets or are built-in to the structure of a toilet. Some of these devices consist of emitting pleasant odors when the toilet is in use or provide aspiration systems which draw air from the room in which the toilet is located and directs it outside. Many other devices, too numerous to describe herein, are also known to deal with this problem.

SUMMARY OF THE INVENTION

The present invention relates to a toilet bowl aspirating system which is actuated when the toilet is in use and which is kit provided in kit form and easily adaptable to existing toilets without modifying the existing mechanism and wherein the aspirating system is contained, in one of its preferred embodiments, within the toilet tank and powered by its own power supply also contained within the tank.

A further feature of the present invention is to provide a toilet bowl aspirating system which can be easily adapted to existing toilets within the water tank thereof without the use of special tools and wherein its adaptation is simple to apply with only a few modifications needed.

Another feature of the present invention is to provide a toilet bowl aspirating system which is efficient and economical and which requires minimum servicing.

According to the above features, from a broad aspect, the present invention provides a toilet bowl aspirating system for use in a toilet tank having an overflow tube in which a filler tube is disposed to supply water to a channel having a plurality of ports provided in a rim of a toilet bowl and through which water flows about an inner side wall of the bowl during an evacuation cycle. The aspirating system comprises a blower support member having a tubular adapter for seating engagement over a top end of the overflow tube and extending below a top water level of the toilet tank to provide a closed chamber above the top end of the overflow tube. The blower support member has an exhaust end positioned above the top water level. A blower is secured in the exhaust end for drawing air from the top end of the overflow tube and the plurality of ports within the toilet bowl and which are in communication with the overflow tube. Conduit means are provided in the support member to communicate the filler tube in the top end of the overflow tube. A power supply means is provided to power the blower. Timer means is responsive to switch means to apply power to the blower for a predetermined period of time. Filter means is also associated with the exhaust end to filter odors emitted therefrom by operating the blower.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
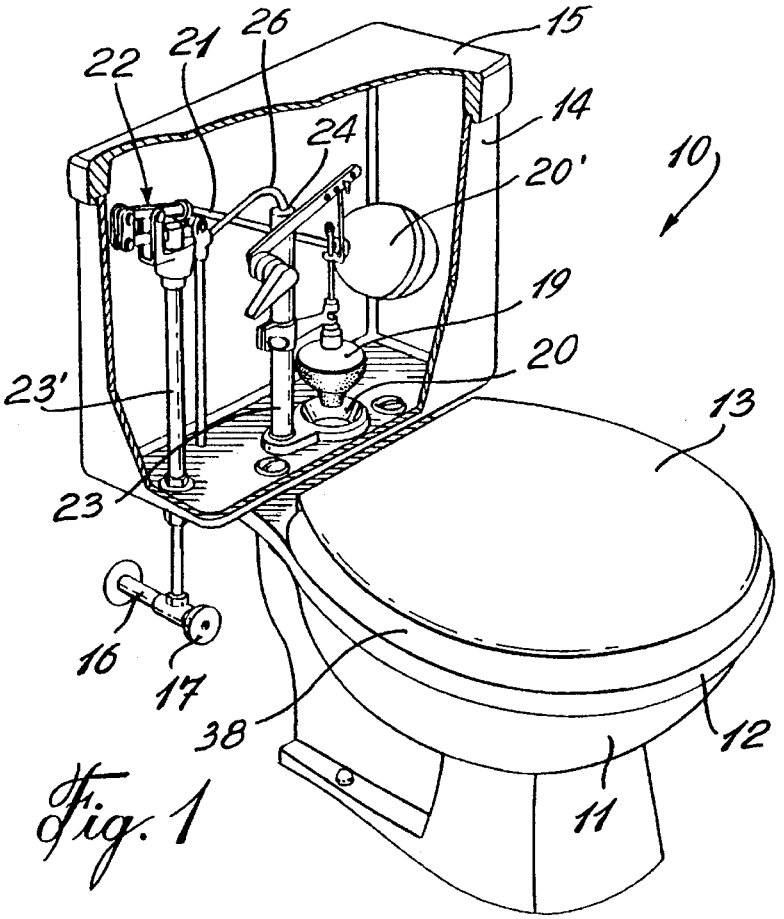
FIG. 1 is a perspective view of the construction of a toilet as is well known in the prior art.

Referring now to the drawings, and more particularly to FIG. 1, there is shown generally at 10, a toilet as is commonly known in the prior art. The toilet consists essentially of a bowl 11 having a rim 12 on which a seat 38 having a cover 13 is hingedly secured. A water tank 14 is supported elevated in the rear end of the toilet bowl 11 and has a lid 15 over a top open end thereof. A conduit 16 having a shut-off valve 17 supplies water to the toilet tank 14.

Figure 2:
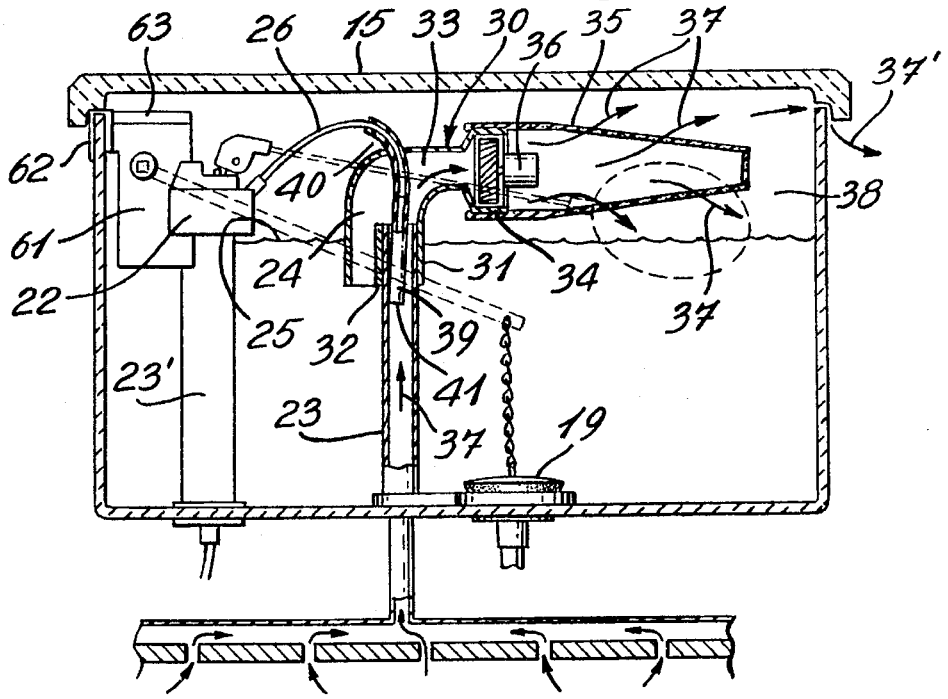
FIG. 2 is a simplified section view showing the toilet bowl aspirating system of the present invention installed in a toilet tank.

A trip handle 18 is actuated to withdraw a plunger 19 from a valve seat 20 in order to release water from within the tank to evacuate the contents within the toilet bowl 11. A float ball 20' regulates the top water level within the tank and is connected by a float arm 21 to a ball-cock assembly 22. The assembly 22 is supported on top of an inlet tube 23' providing the water supply to the tank. An overflow tube 23 extends within the tank and has a top end 24 located above the top water level 25, as shown in FIG. 2, to redirect water within the toilet bowl, should the level 25 of the water exceed the top end 24 of the overflow tube 23. A filler tube 26 supplies water into the overflow tube 23 during a flushing cycle and until the top water level 25 has been replenished within the tank 14 whereby to direct water to a plurality of ports 27 in contact with a channel 28 disposed within the rim 12, see FIG. 2, provided in the top end of the toilet bowl 11.

Figure 3:
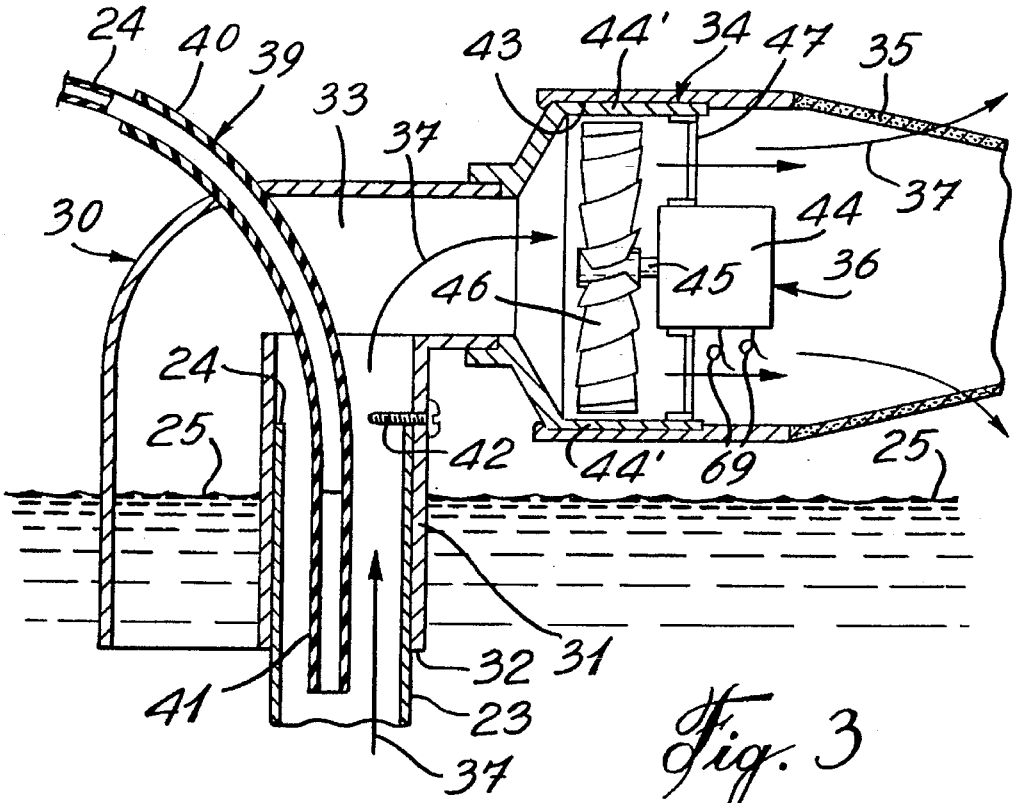
FIG. 3 is an enlarged view showing the construction of the blower support member.

With further reference to FIGS. 2 and 3, there will be described the construction and installation of the toilet bowl aspirating system of the present invention. The aspirating system comprises a blower support member 30 which has a tubular adapter 31 for close sliding fit over the top end 24 of the overflow tube 23. The tubular adapter 31 has a lower end 32 which extends below the top water level 25 to provide a closed chamber 33 above the top end of the overflow tube 23. The blower support member 30 has an exhaust end 34 which is also positioned above the top water level 25 at a predetermined distance therefrom whereby to receive thereabout a filter element 35.

As herein shown, a blower 36 is secured in the exhaust end 34 and draws air from the top end of the overflow tube and hence the plurality of ports 27 and the air within the toilet bowl and this air flow is indicated by arrows 37. Because the ports 27 are in communication within the toilet bowl 11 when a person is sitting on the toilet seat 38, air from within the toilet bowl will be aspirated through the overflow tube by the blower 36 and filtered by the filter element 35 and escapes from the area 38 above the top water level 25 through the spaces about the cover 15 and the top edge of the tank 14, which are never in perfect sealing engagement. This filtered air escape is indicated by arrow 37'.

It can also be seen that the blower support member 30 is also provided with a conduit 39 which has an outer end portion 40 disposed above the member 30 and a lower end 41 which extends beyond the lower end 32 of the tubular adapter 31. The member 30 has an extension tube 30' which extends below the top water level 25 and provides communication with the top end of the tubular adapter 31 to permit evacuation of water in the tank 14 when it rises above the level of the top end of the adapter 31.

As better seen in FIG. 1, before the blower support member 30 is disposed over the top end 24 of the overflow tube 23, the filler tube 26 was removed and it is now repositioned in close fit within the top end 40 of the conduit 39. Also, the tubular adapter 31 is provided with an abutment element, herein a screw 42, at a predetermined location therein, and projects inwardly within the tubular adapter 31 for seating abutment on the top end or top edge 24 of the overflow tube 23. This provides for the exhaust end 34 to be positioned at a predetermined distance spaced above the top water level 25 of the tank to ensure that the filter element 35 is not in contact with the water within the tank.

As herein shown, the filter element 35 is constructed as a thick pouch of flexible material impregnated with a carbon substance and has an open end 43 which is dimensioned for close fit over a collar 44' provided at the exhaust end 34. The flexible material of the filter has sufficient rigidity to support itself spaced above the top water level 25 and also provides protection and sound absorption of the blower 36 which is mounted within the collar 44'. The filter is easily interchangeable. The tubular member 39 and the filler tube 24 are both constructed of flexible plastic tubes. The reason that the lower end 41 of the plastic tubular member 39 extends beyond the lower end 32 of the tubular adapter 31 is that it facilitates positioning this lower end 41 within the top end 24 of the overflow tube 23 during installation of the support member 30.

As shown in FIG. 3, the blower 36 is comprised of a DC motor 44 having a rotatable shaft 45 to which a fan 46 is secured. The motor 44 is supported within a support frame or housing 47 which is glued or otherwise supported within the collar 44'

Figure 4:
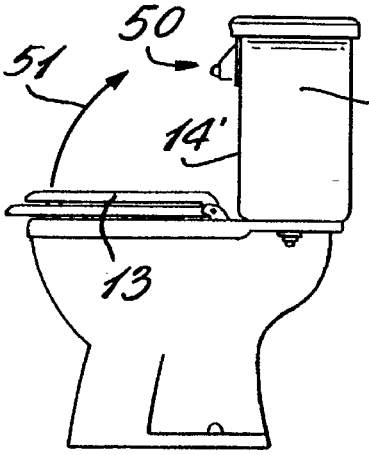
FIG. 4 is a simplified side view of a toilet showing the location of the switch which is actuated by a toilet seat.

With additional references to FIGS. 4 to 7, there will be described the manner in which the blower 36 is operated. As shown in FIG. 4, a blower activating switch 50 is secured over the top rim of the tank 14 and positioned centrally over the front wall 14' of the tank whereupon lifting of the toilet seat 13 in the direction of arrow 51, and striking the switch 50 will cause actuation.

Figure 5:
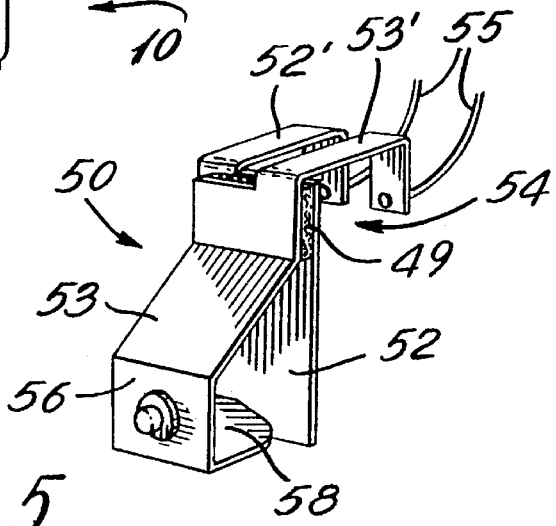
FIG. 5 is a perspective view showing the construction of the switch as used in FIG. 4.

As shown in FIG. 5, the switch 50 is comprised of a pair of flat contact blades 52 and 53, electrically isolated from one another by a strip of insulating material 49. The blades 52 and 53 are shaped at an end 53' and 52' to define a U-shaped clamp 54 whereby to hook the switch over the top edge of the tank 14. These U-shaped ends 53' and 52' of the contact blades also constitute terminal ends to which wires 55 are connected to respective terminals of a battery as will be described later. The forward contact blade 53 has a forwardly disposed section 56 provided with a rubber bumper 57 on which the seat cover 13 will abut whereby to cause the contact end portion 58 of the blade 53 to contact the blade 52 and cause a switch closure to actuate a timing circuit and the blower 36.

Figure 6:
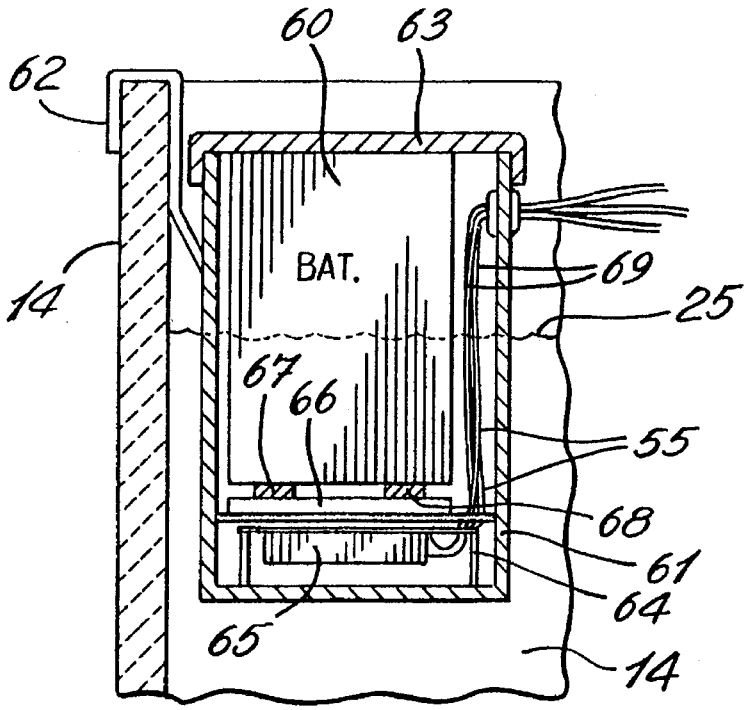
FIG. 6 is a simplified section view showing the construction of the battery housing which is supported internally of the toilet tank.

As shown in FIG. 6, the power supply is provided by a 6 or 9 volt d.c. battery 60 which is secured within a waterproof housing 61 also provided with a clamp 62 to retain same within the upper portion of the water tank 14 and inside thereof. The housing 61 extends partly below the top water level 25 in the tank. If there is no space in the tank, then the battery housing could be disposed outwardly at a convenient location where it is not so apparent. A cover 63 closes the waterproof housing 61. At the base of the housing 61, there is provided a circuit block 64 under which or in which there is secured a timer circuit 65. Conductive strips 66 are provided on the top end of the circuit 64 to connect the wires 55 to the proper terminals 67 and 68 of the battery. Wires 69 are connected to the blower motor 44.

Figure 7:
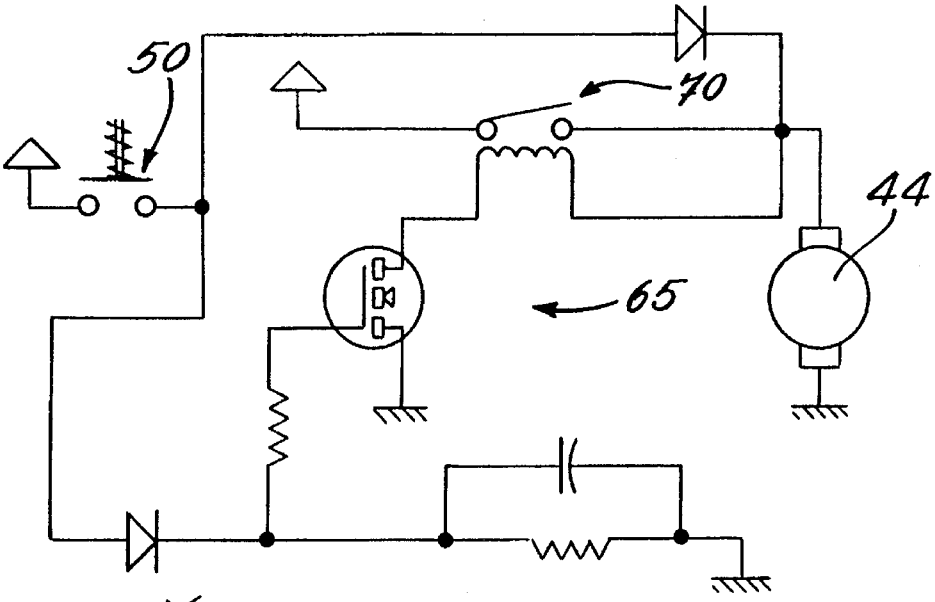
FIG. 7 is a schematic diagram of the control circuit associated with the switch.

The timer circuit 65 is illustrated in FIG. 7 and maintains power to the motor 44 during a preset time period, herein four minutes, after the closure of the switch contact 50. After the expiration of the timing cycle, power is automatically shut-off from the blower motor 44 by the actuation of a relay 70. Should it be desired to maintain the blower actuated for a further cycle, or more cycles, all that is necessary to do is for the user to apply pressure against the seat cover 13 lying in front of the switch 50 whereby to cause a further switch closure and a further actuation of the supply circuit during a further four minute time cycle.

It is within the ambit of the present invention to cover any other obvious modifications, provided such modifications are encompassed within the scope of the appended claims.

I claim:

1. A toilet bowl aspirating system for use in a toilet tank having an overflow tube in which a filler tube is disposed to supply water to a channel having a plurality of ports provided in a rim of a toilet bowl and through which water flows about an inner side wall of said bowl during an evacuation cycle, said aspirating system comprising a blower support member having a tubular adapter for seating engagement over a top end of said overflow tube and extending below a top water level of said toilet tank to provide a closed chamber above said top end of said overflow tube, said blower support member having an exhaust end positioned above said top water level, a blower secured in said exhaust end for drawing air from said top end of said overflow tube and said plurality of ports within said toilet bowl and which are in communication with said overflow tube, conduit means in said support member to communicate said filler tube in said top end of said overflow tube, power supply means to power said blower, timwer means responsive to sw3itch means to apply power to said blower for a predetermined period of time, and filter means associated with said exhaust end to filter odors emitted therefrom by operating said blower, said tubular adapter being a pipe section having an abutment element projecting inwardly therein for seating abutment on a top edge of said overflow tube to position said exhaust end above said top water level, said conduit means being a tubular member extending within said pipe section beyond a lower end of said pipe section to position same in a top end of said overflow tube, said tubular member having an inner diameter adapted to receive a free end of said filler tube in close fit therein.

2. An aspiration system as claimed in claim 1 wherein said filter means is a carbon filter detachably secured about said exhaust end.

3. An aspiration system as claimed in claim 2 wherein said carbon filter is constructed as a pouch of flexible material impregnated with a carbon substance and having an open end dimensioned for close fit over a collar of said support member about said exhaust end, said flexible material having sufficient rigidity to support itself above said top water level.

4. An aspiration system as claimed in claim 2 wherein said conduit means is a tubular member extending within said pipe section beyond a lower end of said pipe section to position same in a top end of said overflow tube, said tubular member having an inner diameter adapted to receive a free end of said filler tube in close fit therein.

5. An aspiration system as claimed in claim 1 wherein said tubular adapter is a pipe section having an abutment element projecting inwardly therein for seating abutment on a top edge of said overflow tube to position said exhaust end above said top water level.

6. An aspiration system as claimed in claim 1 wherein said tubular member and said filler tube are flexible plastic tubes.

7. An aspiration system as claimed in claim 1 wherein said blower is comprised of a d.c. motor having a rotatable shaft, a fan secured to said shaft, and a motor support housing, said support housing being retained in said exhaust end of said blower support member.

8. An aspiration system as claimed in claim 7 wherein said power supply means is a d.c. battery secured in a waterproof housing having a clamp to secure said housing in a top end of said toilet tank inwardly thereof, and a cover for said housing.

9. An aspiration system as claimed in claim 8 wherein said timer means is a timer circuit interconnected between said battery and said d.c. motor of said blower, said switch means causing said timer circuit to be energized when a seat cover of said toilet bowl is placed in an upright position to actuate said switch means.

10. An aspiration system as claimed in claim 9 wherein said switch means is provided by a pair of flat contact blades, said blades being shaped at one end to define a U-shaped clamp for attachment over a top edge of a front wall of said toilet tank, one of said contact blades having a forwardly disposed arm for engagement by a surface portion of said seat cover when in said upright position, said contact blades being electrically isolated from one another.

11. An aspiration system as claimed in claim 1 wherein said blower support member is further provided with an extension tube which extends below said top water level and communicating with said top end of said overflow tube to permit evacuation of water from said toilet tank through said top end of said overflow tube when the water in said tank rises above said top end of said overflow tube.

* * * * *